US006933447B1

(12) United States Patent
Marc

(10) Patent No.: US 6,933,447 B1
(45) Date of Patent: Aug. 23, 2005

(54) ELECTRICAL EXTENSION CORD

(76) Inventor: Robert Marc, 13403 Ripple La., Lakeside, CA (US) 92040

( * ) Notice: Subject to any disclaimer, the term of this patent is extended or adjusted under 35 U.S.C. 154(b) by 0 days.

(21) Appl. No.: 10/821,209

(22) Filed: Apr. 7, 2004

(51) Int. Cl.[7] ..... H01B 7/00
(52) U.S. Cl. ..... 174/135; 174/74 R; 439/622
(58) Field of Search ..... 439/459, 460, 439/464, 622; 174/46, 72 C, 73.1, 74 R, 174/135

(56) References Cited

U.S. PATENT DOCUMENTS

| | | | | | |
|---|---|---|---|---|---|
| 2,108,907 | A | * | 2/1938 | Te Pas | 439/460 |
| 2,422,393 | A | * | 6/1947 | Bryant | 439/459 |
| 2,528,971 | A | * | 11/1950 | Philips | 439/622 |
| 2,721,717 | A | * | 10/1955 | Wales | 174/135 |
| 2,728,058 | A | * | 12/1955 | Phalen | 439/371 |
| 3,316,523 | A | * | 4/1967 | Trangmar | 439/369 |
| 4,679,877 | A | | 7/1987 | Ahroni | 439/425 |
| 4,917,625 | A | * | 4/1990 | Haile | 439/358 |
| 4,998,891 | A | * | 3/1991 | Bresko | 439/369 |
| 5,069,634 | A | | 12/1991 | Chiarolanzio | 439/353 |
| 5,529,522 | A | * | 6/1996 | Huang | 439/480 |
| 5,586,898 | A | * | 12/1996 | Anderson et al. | 439/287 |
| 5,906,515 | A | * | 5/1999 | Lin | 439/622 |
| 6,517,373 | B2 | | 2/2003 | Finke | 439/352 |

* cited by examiner

*Primary Examiner*—Dean A. Reichard
*Assistant Examiner*—Adolfo Nino
(74) *Attorney, Agent, or Firm*—Goldstein Law Office PC.

(57) ABSTRACT

An electrical extension cord that has a male or female adapter, a cylindrical wire casing and a connecting clamp. The adapter has a circular face, a cylindrical upper portion and a conical lower portion. If a male adapter is employed, two to four prongs protrude from the face in a perpendicular direction. If a female adapter is employed, two to four openings are embedded in the face. The prongs and openings are in electrical communication with a power supply. The width of the upper portion is equal to the diameter of the face. In contrast, the lower portion narrows continuously to a minimum diameter that is preferably slightly less than the outer diameter of the casing. The clamp consists of a top plate and a bottom plate that are fastened together by bolts.

4 Claims, 3 Drawing Sheets

ELECTRICAL EXTENSION CORD

BACKGROUND OF THE INVENTION

1. Field of the Invention

The invention generally relates to an electrical extension cord, and in particular it relates to an electrical extension cord that slides smoothly over edges between various surfaces.

2. Description of the Related Art

Extension cords are often used to transmit power to locations that are removed from conventional electrical outlets. They provide a continuous connection between power sources and devices that require electricity to function properly, such as lights, tools and industrial equipment. Generally, an extension cord consists of an adapter, into which a plug that is attached to the device can be inserted, and an encased wire that travels from the adapter to the power supply. Each adapter can have either of two basic configurations: metallic prongs that project from a circular face in a perpendicular direction (a so-called "male adapter") or openings that are embedded in the face (a so-called "female adapter"). The number of prongs present in male adapters can range from two to four, while the number and shape of the openings in female adapters are designed to receive prongs from a corresponding male adapter.

However, a significant problem is associated with the use of nearly all commercially available extension cords. Namely, each extension cord snags on edges between various surfaces because of the geometry of the interface between its adapter and its wire. This scenario usually develops when a user pulls or reels in the extension cord. In order to effectively utilize the extension cord, the user must access the cord, lift the adapter and reposition the adapter-wire interface on a flat surface. Doing so is usually a frustrating and time-consuming task. It can also be dangerous if, for example, the user is operating a portable power tool while freeing the cord. Hence, there is a pressing need for an extension cord that is specifically designed to slide smoothly over commonly encountered edges.

U.S. Pat. No. 4,679,877 to Ahroni ("Ahroni") teaches an electric plug with snap-fitted housing components. However, an extension cord that has the plug of Ahroni would readily snag on edges.

U.S. Pat. No. 5,069,634 to Chiarolanzio ("Chiarolanzio") discloses an electrical connection device that engages the plug and receptacle ends of electrical devices with extension cords or an electrical cord with a power receptacle. However, an extension cord that has the device of Chiarolanzio would readily snag on edges.

U.S. Pat. No. 6,517,373 B2 to Finke et al. ("Finke") teaches a circular electrical connector. However, an extension cord that has the connector of Finke would readily snag on edges.

While these devices may be suitable for the particular purposes employed, or for general use, they would not be as suitable for the purposes of the present invention as disclosed hereafter.

SUMMARY OF THE INVENTION

It is an object of the invention to provide an extension cord that can be utilized with various types of electrical devices. Accordingly, the extension cord has a male or female adapter from which two to four prongs protrude or into which a corresponding number of openings are embedded.

It is another object of the invention to provide an extension cord that can be utilized with power supplies of various capacities. Accordingly, the extension cord has a wire that a user can plug into 110-volt and 220-volt AC power receptacles.

It is a further object of the invention to provide an extension cord that does not snag on edges between various surfaces. Accordingly, the extension cord has an adapter whose width gradually decreases from a maximum of its face diameter to a minimum of slightly less than the diameter of the wire casing with which it connects.

It is a further object of the invention to provide an extension cord that securely connects the adapter to the wire casing. Accordingly, the extension cord has a clamp, positioned inside a lower portion of the adapter, which is wider than the minimum diameter of the adapter.

The invention is an electrical extension cord that has a male or female adapter, a cylindrical wire casing and a connecting clamp. The adapter has a circular face, a cylindrical upper portion and a conical lower portion. If a male adapter is employed, two to four prongs protrude from the face in a perpendicular direction. If a female adapter is employed, two to four openings are embedded in the face. The prongs and openings are in electrical communication with a power supply. The width of the upper portion is equal to the diameter of the face. In contrast, the lower portion narrows continuously to a minimum diameter that is preferably slightly less than the outer diameter of the casing. The clamp consists of a top plate and a bottom plate that are fastened together by bolts.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
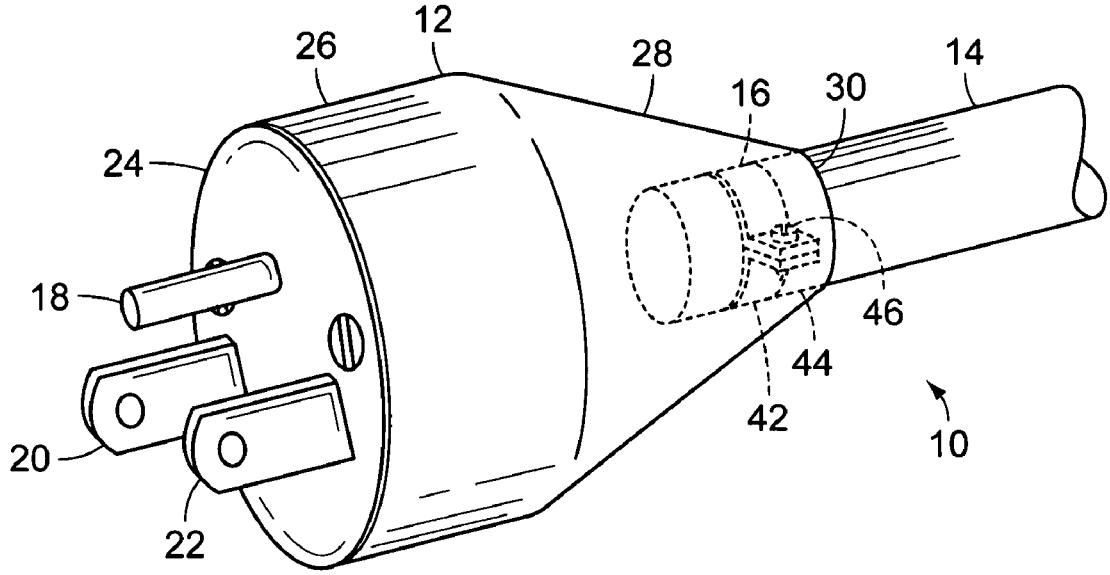
FIG. 1 is a diagrammatic perspective view of an extension cord according to the present invention with a male adapter and a clamp shown in hidden lines.

FIG. 1 depicts an electrical extension cord 10 according to the present invention for use with an electrical device. The extension cord 10 has a male adapter 12, a cylindrical wire casing 14 and a clamp 16 that connects them. A plurality of prongs 18, 20 and 22 protrudes from a circular face 24 in a perpendicular direction and are in electrical communication with a power supply. Although the adapter 12 is shown with three prongs, it can alternatively have two or four prongs.

The number of prongs that extend from the face 24 depends upon the configuration of the plug attached to the device into which the prongs insert. Structurally, the adapter 12 has a cylindrical upper portion 26 and a conical lower portion 28. The upper portion 26 has a diameter equal to the diameter of the face 24, which is the maximum width of the adapter 12. In contrast, the lower portion 28 tapers continuously in the direction of the casing 14 and narrows to a minimum diameter 30. The minimum diameter 30 is no greater than, and preferably is slightly less than, the outer diameter of the casing 14.

The lower portion 28 narrows very gradually and therefore is considerably longer than the upper portion 26. Thus, the width of the lower portion 28 at a location close to the upper portion 12 is nearly equal to the diameter of the face 24, while the comparable width at a position near the adapter-wire interface is only slightly greater than the minimum diameter 30. This design ensures that the interface between the lower portion 28 and the wire casing 14 is barely perceptible. It also prevents the adapter 12 from becoming snagged on an edge between two surfaces while the user employs the cord 10. The importance of this latter feature will not escape consumers who utilize extension cords frequently. The cord 10 does not snag and thereby impose upon the user the frustrating and time-consuming burden of freeing it.

Figure 2:
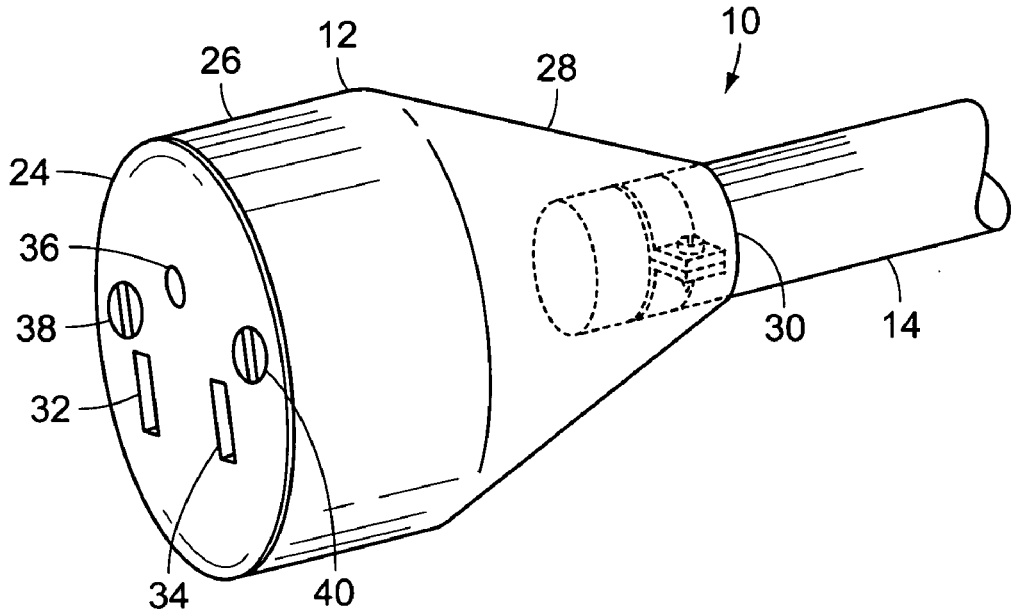
FIG. 2 is a diagrammatic perspective view of the extension cord with a female adapter and a clamp shown in hidden lines.

FIG. 2 illustrates the cord 10 with a female adapter 12. The face 24 contains a plurality of embedded openings 32, 34 and 36 that is in electrical communication with the power supply. Although the adapter 12 is shown with three openings, it can alternatively have two or four openings. The number and shapes of the openings 32, 34 and 36 depend upon the configuration of the plug from the electrical device which inserts into them. A pair of screws 38 and 40 attaches the face 24 to the upper portion 26 of the adapter 12. In addition, the clamp 16 includes a top plate 42 with flat planar ends and a bottom plate 44 with flat planar ends. The top plate 42 rests directly on top of, and is aligned with, the bottom plate 44. Preferably, the top plate 42 and the bottom plate 44 are made from the same metallic alloy and have the same thickness. Bolts 46 and 48 extend through holes that are drilled into the ends of the top plate 42 and the bottom plate 44, which it fastens firmly together. The clamp 16 is located inside the lower portion 28 of the adapter 12 at a position near the interface with the casing 14. The clamp 16 is wider than the minimum diameter 30 and thus permanently secures the adapter 12 to the casing 14.

Figure 3:
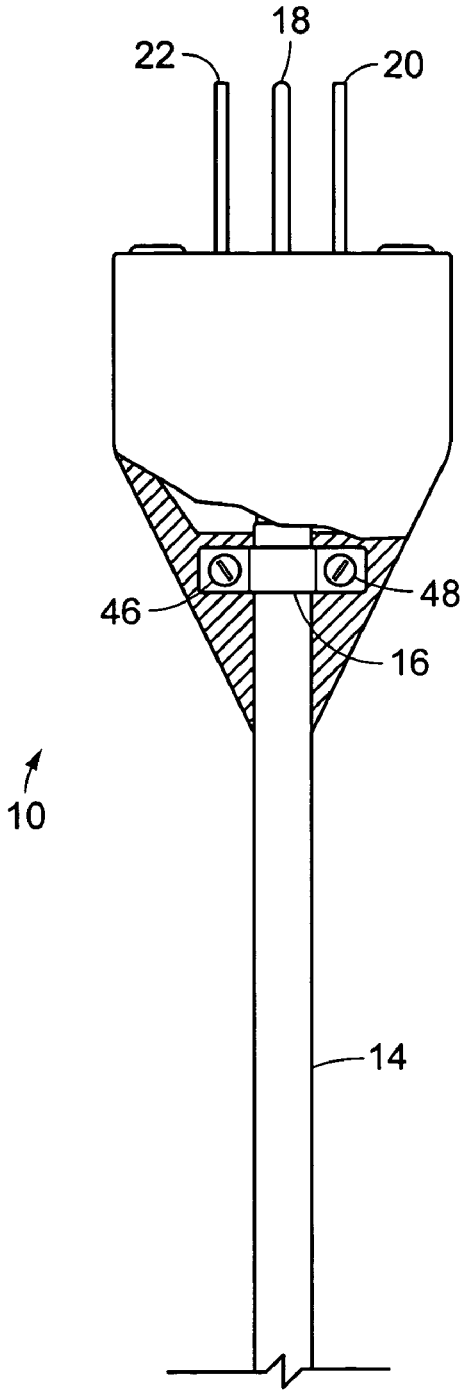
FIG. 3 is a top elevational view with parts broken away of the extension cord illustrated in FIG. 1.

FIG. 3 shows a top elevational view with parts broken away of the cord 10 illustrated in FIG. 1. The casing 14 contains, and effectively shields, a plurality of elongated electrical wires that are present inside its central cavity. Various durable heavy-duty polymers can be used to construct the casing 14.

Figure 4:
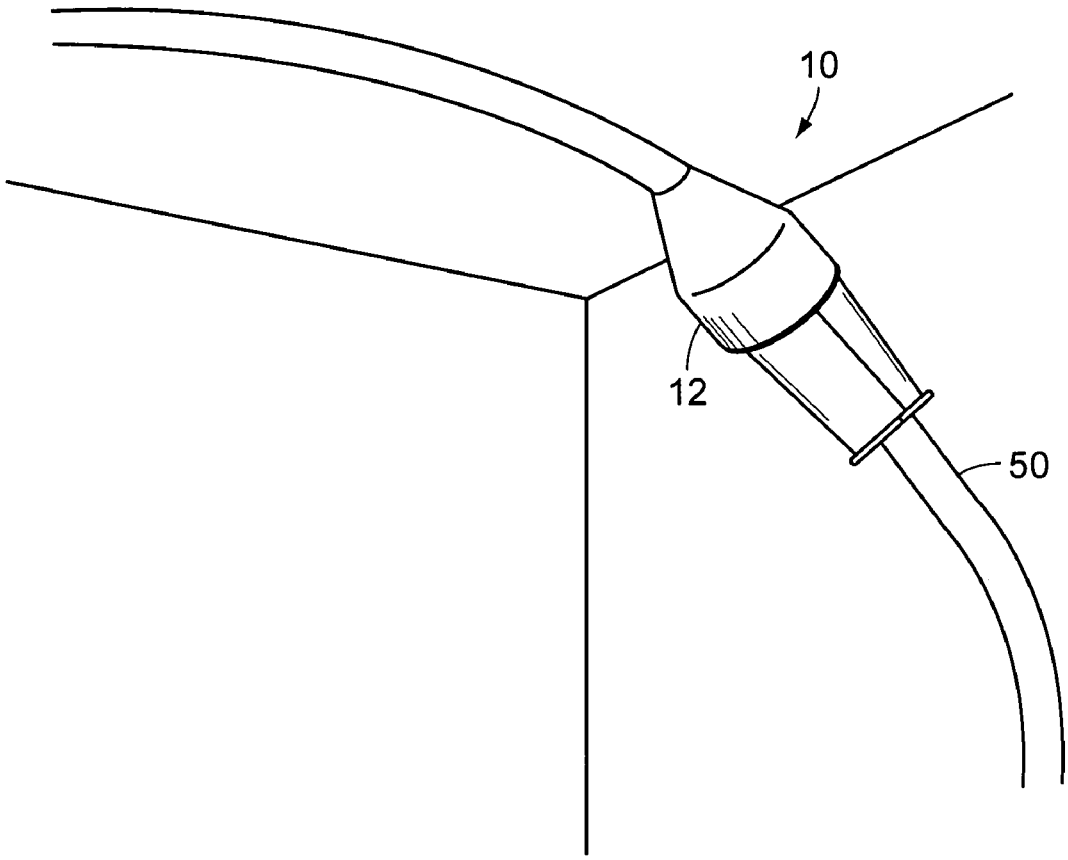
FIG. 4 is a diagrammatic perspective view of the extension cord connected to a plug from an electrical device.

FIG. 4 depicts the cord 10 in use. The cord 10 is connected to a plug 50 from an electrical device of any type. The structure of the adapter 12 prevents the cord 10 from getting snagged on the edge.

In conclusion, herein is presented an electrical extension cord. The invention is illustrated by example in the drawing figures, and throughout the written description. It should be understood that numerous variations are possible, while adhering to the inventive concept. Such variations are contemplated as being a part of the present invention.

What is claimed is:

1. An extension cord for transmitting electricity from a power supply to an electrical device and sliding smoothly over edges, comprising:

a cylindrical wire casing that contains a plurality of elongated electrical wires, the casing shielding the wires from the external environment, the casing having an outer diameter;

an adapter that has a circular face, a cylindrical upper portion and a conical lower portion, the face being attached to the upper portion by a pair of screws, the face having a diameter, the upper portion having a diameter that is equal to the face diameter, the lower portion tapering continuously and narrowing to a minimum diameter that is no greater than the outer diameter of the casing;

a clamp that connects the adapter and the wire casing, the clamp being positioned inside the lower portion, the clamp having a top plate with flat planar ends and a bottom plate with flat planar ends, the top plate being securely fastened to the bottom plate, the clamp being wider than the minimum diameter.

2. The extension cord as recited in claim 1, wherein the adapter has a plurality of prongs protruding from the face in a perpendicular direction, the prongs being in electrical communication with the power supply.

3. The extension cord as recited in claim 2, wherein the adapter has a plurality of openings embedded in the face, the openings being in electrical communication with the power supply.

4. The extension cord as recited in claim 3, wherein the top plate and the bottom plate are made from the same metallic alloy and are equally thick.

* * * * *